US006813795B2

(12) United States Patent
Graves

(10) Patent No.: US 6,813,795 B2
(45) Date of Patent: Nov. 9, 2004

(54) SHOE AND BOOT CLEANING DEVICE

(76) Inventor: Judy Graves, 109 Burgess Rd., Dickson, TN (US) 37055-5246

( * ) Notice: Subject to any disclaimer, the term of this patent is extended or adjusted under 35 U.S.C. 154(b) by 0 days.

(21) Appl. No.: 10/628,124

(22) Filed: Jul. 28, 2003

(65) Prior Publication Data

US 2004/0019988 A1 Feb. 5, 2004

Related U.S. Application Data

(63) Continuation-in-part of application No. 09/878,881, filed on Jun. 11, 2001, now abandoned, which is a continuation-in-part of application No. 09/370,922, filed on Aug. 9, 1999, now abandoned.

(51) Int. Cl.[7] ..... A47L 23/22

(52) U.S. Cl. ..... 15/36; 15/112; 15/161; 15/237

(58) Field of Search ..... 15/36, 30, 32, 15/33, 34, 35, 21.1, 112, 97.2, 161, 237

(56) References Cited

U.S. PATENT DOCUMENTS

| | | | | | |
|---|---|---|---|---|---|
| 20,359 | A | * | 5/1858 | McKeachnei | 15/112 |
| 188,612 | A | * | 3/1877 | Ellis et al. | 15/112 |
| 195,801 | A | * | 10/1877 | Condry et al. | 15/112 |
| 965,176 | A | * | 7/1910 | Geraldson | 15/36 |
| 1,223,195 | A | * | 4/1917 | Molinaro | 15/36 |
| 3,060,475 | A | * | 10/1962 | Dufault | 15/36 |
| 3,094,727 | A | * | 6/1963 | Osteen | 15/4 |
| 4,358,867 | A | * | 11/1982 | Berta | 15/36 |

FOREIGN PATENT DOCUMENTS

| | | | | |
|---|---|---|---|---|
| FR | 1323751 | * | 3/1963 | 15/36 |

* cited by examiner

*Primary Examiner*—Gary K. Graham
(74) *Attorney, Agent, or Firm*—John D. Gugliotta; P. Jeff Martin; Olen L. York, III

(57) ABSTRACT

A shoe and boot cleaning device is disclosed, comprised of a main housing of a generally rectangular, hollow box configuration. A scraping blade is used to scrape mud off of shoes and boots. At least one rotating brush is used to clean off debris from the bottom of the shoes and boots. A drawer is located on the bottom of the main housing and collects the mud and dirt from the shoes and boots. The drawer can be removed for easy cleaning.

15 Claims, 12 Drawing Sheets

SHOE AND BOOT CLEANING DEVICE

RELATED APPLICATIONS AND DISCLOSURES

The present application is a Continuation in Part of Ser. No. 09/878,881, filed on Jun. 11, 2001 now abandoned, which is a Continuation in Part of Ser. No. 09/370,922, filed on Aug. 9, 1999.

BACKGROUND OF THE INVENTION

1. Field of the Invention

The present invention relates generally to shoe cleaning devices, and, more particularly, to a shoe and boot cleaning device.

2. Description of the Related Art

As anyone who works outside for a living knows, dirty shoes and/or boots are a fact of life. Farming, working on a construction site, or just general walking is guaranteed to allow for the accumulation of dirt and mud. Additionally snow, ice, waste products and the like can accumulate on the sole of the boot or shoe. One method of dealing with this is to remove the footwear whenever entering the home or business. While this method undoubtedly works the best, it certainly is not the most practical due to the large amount of time it takes. Another method consists of scraping one's foot along the grass or other horizontal surfaces to remove the debris.

However, this method is of little use when there are large accumulations of mud or dirt on the shoe. Finally, the use of a stick or other object to clean the shoe is possible. This method usually involves the uncomfortable situation of one trying to balance on one foot while cleaning the other. Whatever the method chosen, the debris that is removed from the footwear has to be cleaned up itself to prevent it from being tracked into the building. Accordingly, the need has developed for a means by which one can clean their shoes or boots while still being worn, and that allows for the collection of the removed debris such as dirt, mud or snow.

In the related art, several devices are disclosed that describe a boot scraper able to be mounted to skiing implements. These include U.S. Pat. No. 5,713,097, issued in the name of Brown, U.S. Pat. No. 5,142,098, issued in the name of McCrink, U.S. Pat. No. 4,927,176, issued in the name of King et al., U.S. Pat. No. 4,145,063, issued in the name of Knapp et al. and U.S. Pat. No. 3,976,304, issued in the name of Lillibridge et al.

Several patents describe a tool for cleaning cleated shoes. These include U.S. Pat. No. 5,694,660, issued in the name of Rachwalski, U.S. Pat. No. 3,111,698, issued in the name of Heichle and U.S. Pat. No. 2,817,863, issued in the name of Johns.

U.S. Pat. No. 4,425,677, issued in the name of Cox, discloses a shoe cleaning apparatus comprised of a scraper and liquid deodorant.

U.S. Pat. No. D 340,585, issued in the name of Kirk, describes an ornamental design for a ski boot brush.

A search of the prior art did not disclose any patents that anticipate directly many features of the instant invention. Consequently, a need has been felt for providing an apparatus and method which overcomes the problems cited above.

SUMMARY OF THE INVENTION

It is therefore an object of the present invention to provide an improved shoe and boot cleaning device that facilitates cleaning of shoes or boots while still being worn, and that allows for the collection of the removed debris such as dirt, mud or snow.

Briefly described according to one embodiment of the present invention, a shoe and boot cleaning device is disclosed, designed as an apparatus intended to aid in the removal of mud, dirt, or snow from one's shoes when entering indoors while the shoes are still being worn.

To use the present invention, one first wipes his or her feet on a scraper bar located on the left-hand side of the unit. This action is intended to remove any heavy buildup of dirt, mud or snow. Next, the user would scrub his or her foot across a series of inverted brushes on the right-hand side of the unit. This action will remove the remainder of any dirt. An open drawer is located on the bottom of the invention for the purposes of collecting any debris that falls from the shoes while they are being cleaned. The drawer is removable to allow it to be emptied. The use of present invention allows one to keep their shoes clean and avoids tracking dirt into homes, businesses or other buildings.

It is another object of the present invention to provide a device that cleans footwear without removing the footwear.

It is another object of the present invention to provide a device that can be used indoors without creating a mess.

It is another object of the present invention to provide a device that is easy to clean after use, allowing the accumulated dirt to be disposed of quickly and easily.

It is another object of the present invention to provide a device that is capable of removing large amounts of dirt and mud from shoes.

Other objects of the present invention include providing a device that is strong, lightweight and portable.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the FIGS. 1 through 9, and 10*a* through 10*c*.

1. Detailed Description of the Figures

Figure 1:
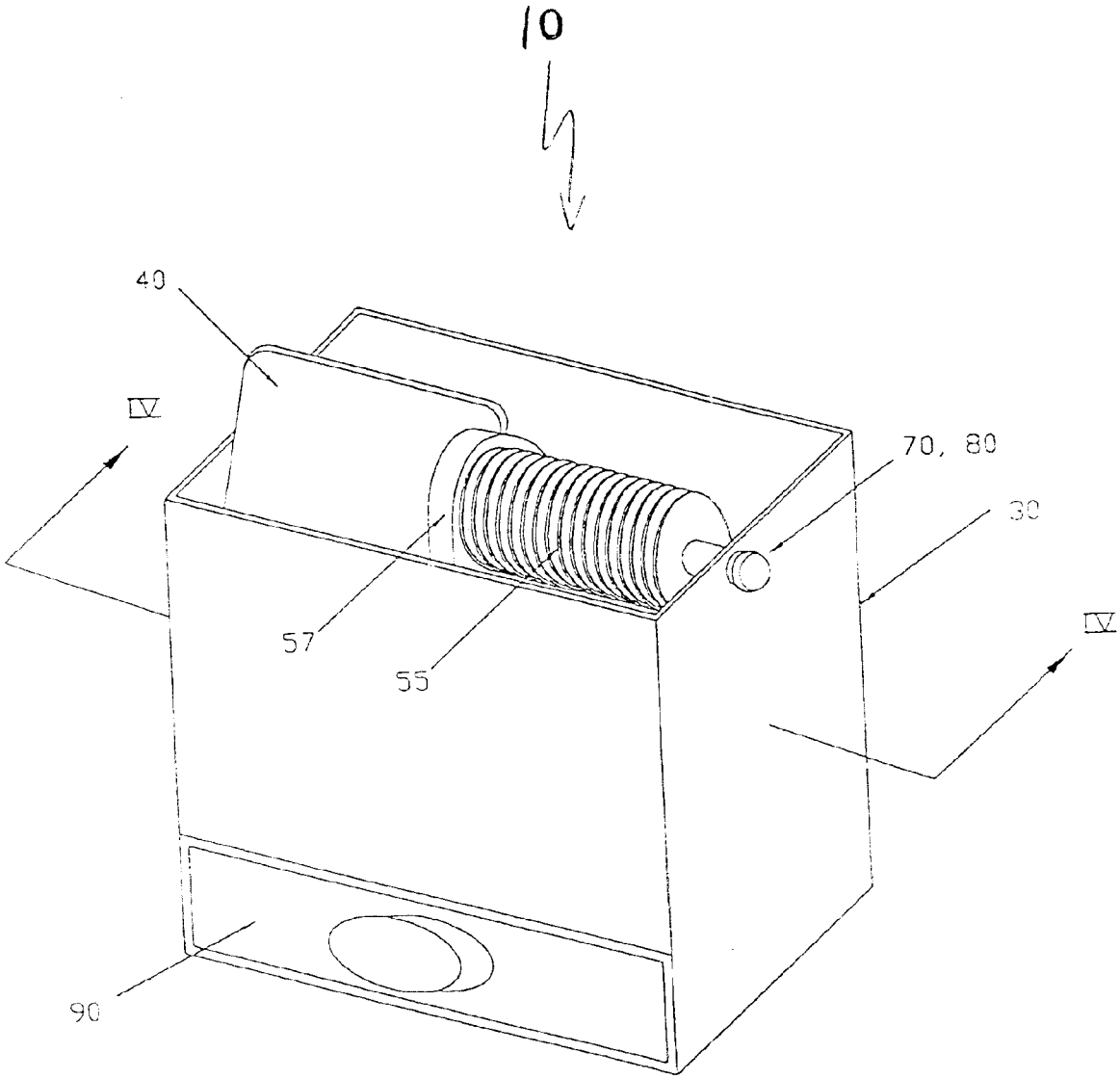
FIG. 1 is a perspective view of the preferred embodiment of a shoe and boot cleaning device 10.

Referring now to FIG. 1, a shoe and boot cleaning device 10 is shown, according to the present invention, designed as an apparatus intended to aid in the removal of mud, dirt, or snow from one's shoes when entering indoors while the shoes are still being worn.

Figure 2:
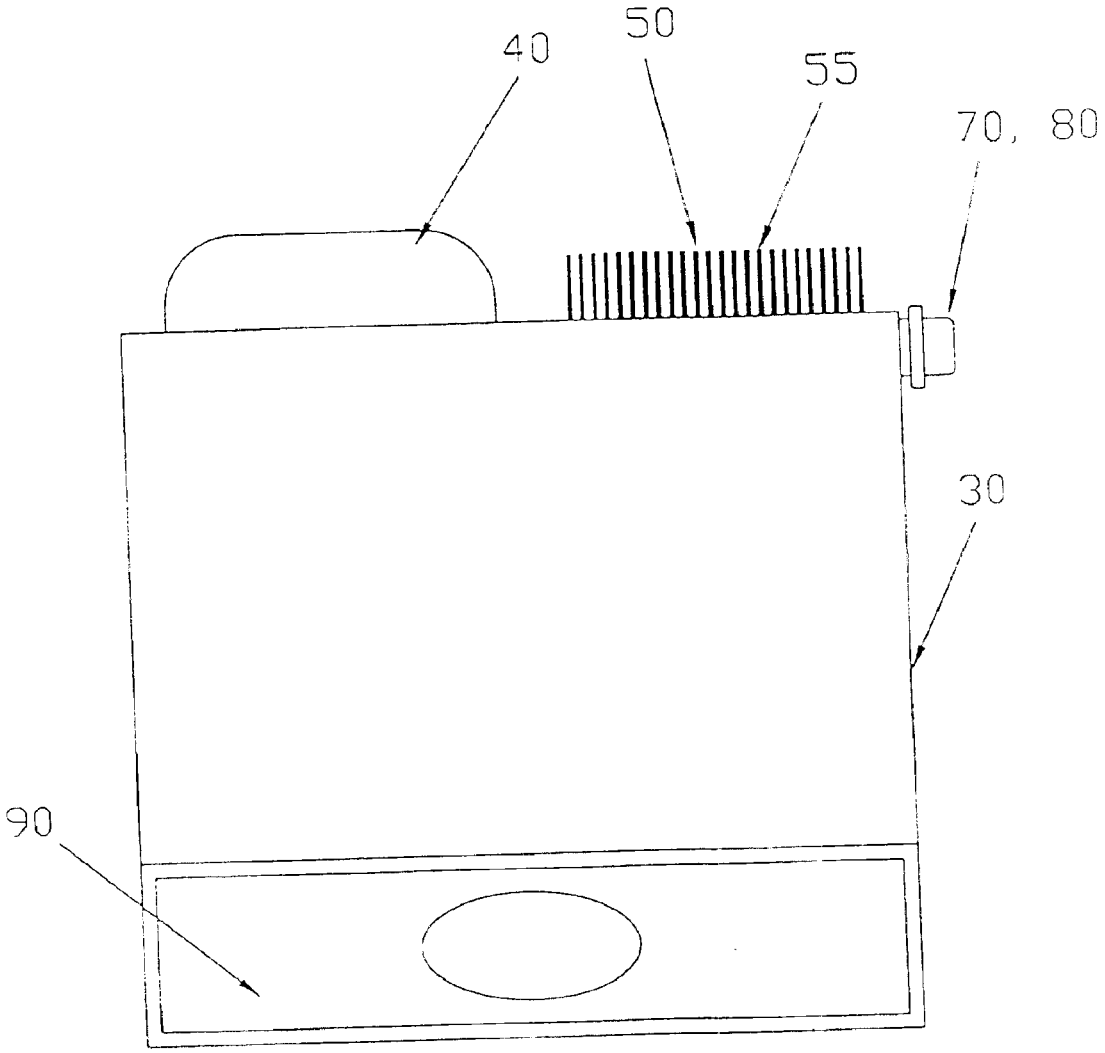
FIG. 2 is a side view thereof.
Figure 3:
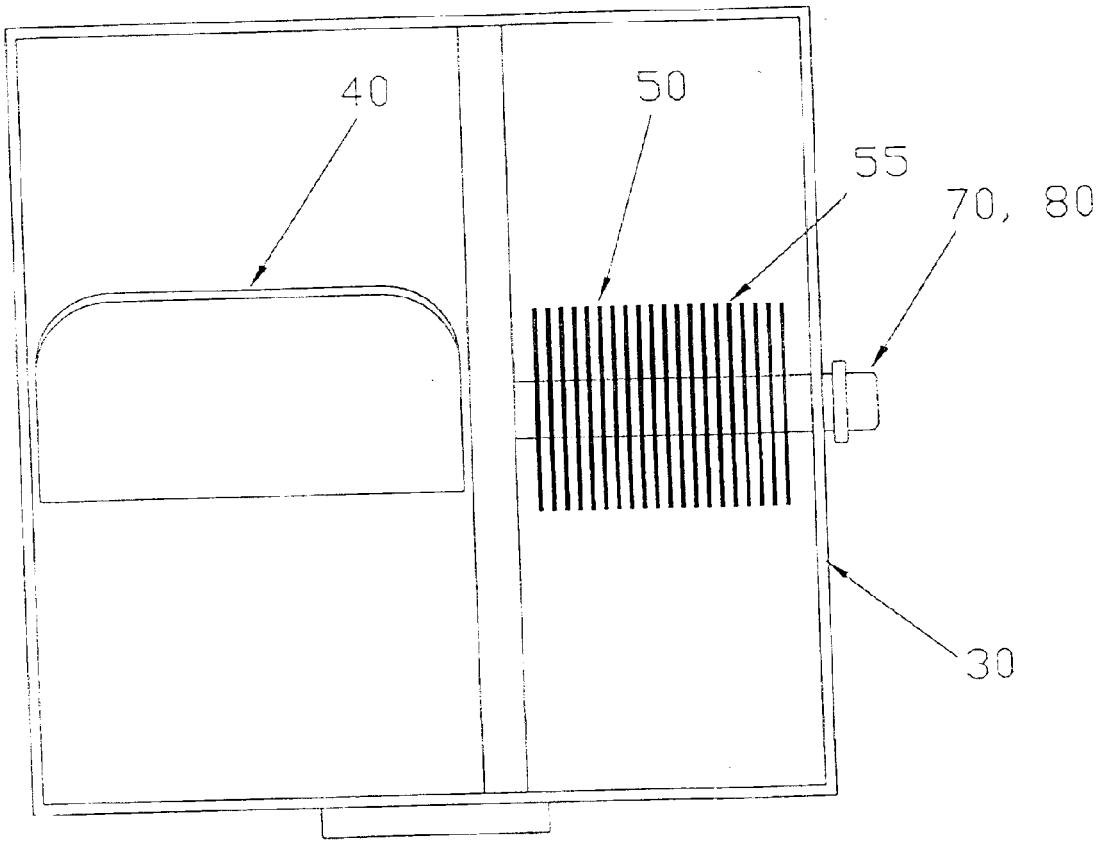
FIG. 3 is a top view thereof.

Referring now to FIGS. 1 through 3, the present invention comprises a main housing 30, of a generally rectangular, box-like configuration. The housing is generally hollow. At least one scraper blade 40 extends vertically upward from the top of the housing. The scraper blade 40 is of a generally rectangular configuration. The scraper blade 40 is designed to remove any heavy buildup of dirt, mud or snow when a shoe or boot bottom is rubbed against the top of the scraper blade. It is envisioned that the scraper blade 40 is constructed of a material selected from the group comprising metal and plastic.

It is envisioned that the scraper blade 40 can be positioned in various vectors along the top surface of the main housing 30. For purposes of disclosure, only one scraper blade is depicted, located at one side of the main housing 30, positioned vertically.

Figure 4:
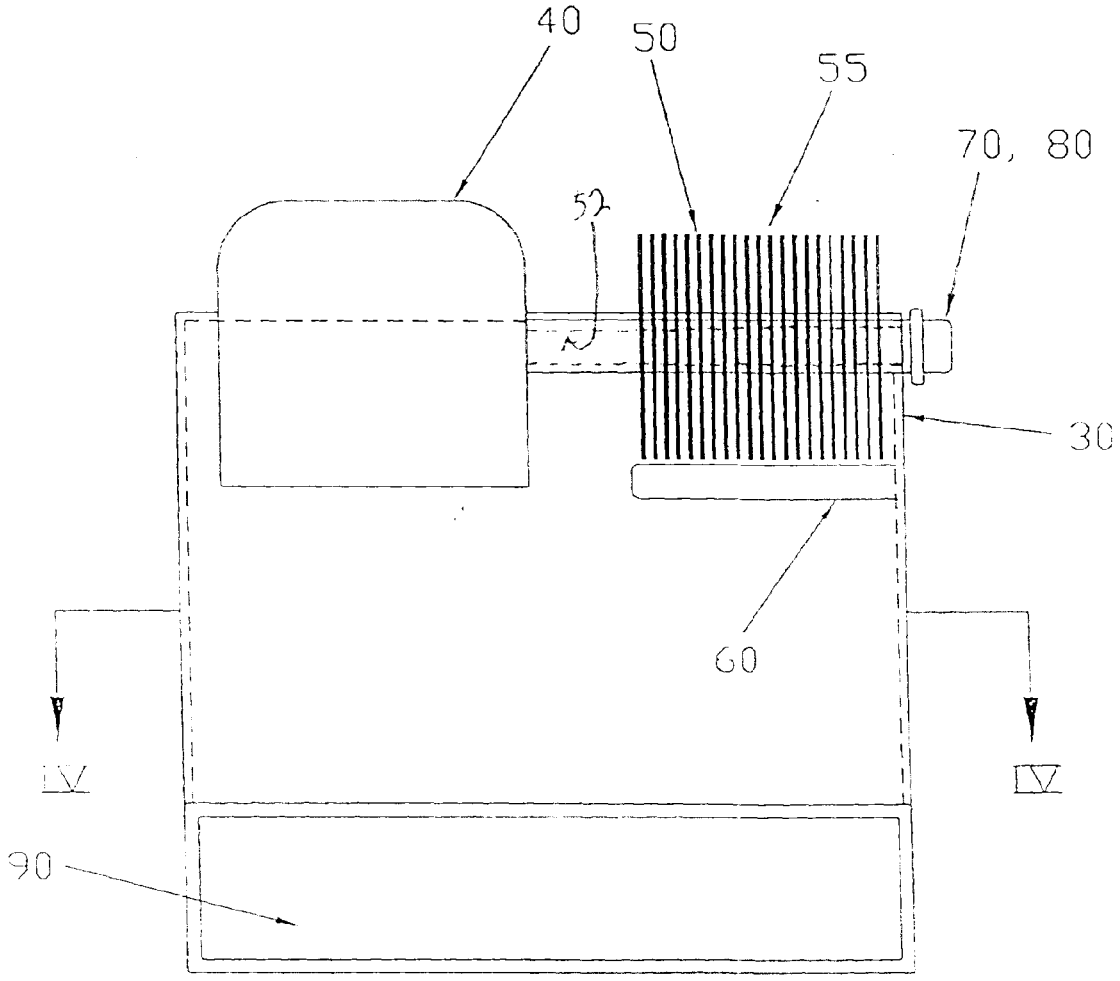
FIG. 4 is a cross sectional view, cut along line IV—IV of FIG. 1.

Referring now to FIG. 4, at least one brush 50, of a linearly elongated, cylindrical configuration is attached to the housing, so that the brush 50 rests horizontally along its elongated axis. The uppermost surface of the brush 50 is elevated above the main housing's interior surface so that a shoe or boot can rest upon the top of the brush 50. The brush 50 rotates along its elongated radial axis about a cylindrical channel 52 formed in the cylindrical brush 50. The channel 52 receives an axle, described below, that allows for application or reduction of rotational drag, respectively, to the brush 50. The brush 50 contains hard bristles 55 along its exterior circumferential surface area. For purposes of disclosure, only one brush 50 is depicted, located next to the scraper blade 40.

It is envisioned that the brush 50 or brushes 50 can be positioned at a variety of angles relative to the horizontal axis of the main housing.

A divider post 57 is used to provide lateral support to the brush 50 and the scraper blade 40. However, other attachment points for the brush 50 and scraper blade 40 are envisioned.

A brush cleaning means 60 is located beneath the brush 50 and is designed to come into mechanical interference with any mud located on the brush 50. The top edge of the brush cleaning means 60 is positioned slightly below the lowermost portion of the brush 50, and is of elongated length comparable to the length of the radial centerline of the brush 50, so as to remove debris from the entire brush 50 exterior surface as the brush 50 rotates. The brush cleaning means 60 is attached to the interior wall of the main housing 30 so as to not interfere with the falling debris reaching the bottom of the present invention.

The brush tension control means 70 is comprised of an axle which extends through a threaded aperture 53 formed in an upper portion of a lateral sidewall of the main housing 30 and is in physical communication with an end thereof to an end 51 of the brush 50 opposite the divider post 57. The axle penetrates the channel 52 formed in brush 50, so that brush 50 may freely and independently rotate about the axle subject to the forces applied to the brush 50. The axle may slightly penetrate the channel 52 or may completely penetrate the channel 52 and mounted to the divider post 57. An opposite end of the axle 58 is formed of a cylindrical knob portion 69 which has a diameter slightly larger than a diameter of the axle 58, so as to facilitate a firm grasp by a user thereof. Corresponding threads, formed along an opposite end of the axle 58, extend a linear distance away from the knob portion 69, and are designed so as to threadably engage the threaded aperture 53 provided in the lateral sidewall of the main housing 30. A tension spring 59, disposed around the axle 58 and having a friction plate 62 mounted at an end thereof adjacent to the end 51 of the brush 50, is biased in such a manner whereby the friction plate 60 is biased laterally against the end 51 of the brush 50, thereby increasing rotational drag thereof and thus requiring a greater external force by a user to rotate the brush 50. Rotation of the knob portion 69 by a user decreases the lateral force of the tension spring 59, thus removing mechanical contact of the friction plate 60 with the end 51 of the brush 50. The resultant functionality provides for a decrease in the rotational drag of the brush 50, thereby requiring less external force by a user to rotate the brush 50. Counter-rotation of the knob portion 69 biases the tension spring 59 laterally in a direction against the end 51 of the brush 50, in turn, biasing the friction plate 62 so as to mechanically contact the end 51 of the brush 50, thereby increasing the rotational drag of the brush 50. The knob portion 69 of the brush tension control means 70 is designed so as to be positioned outside the main housing 30, thereby facilitating easy access thereto by a user.

Referring now to FIGS. 1, 2 and 4, a drawer 90 is located at the bottom of the present invention. The drawer 90 slidably engages the interior of the housing, so as to cover the entire bottom surface of the housing. In this manner, the drawer 90 can catch the debris that falls from the scraper blade 40 and or brush 50. The drawer 90 is capable of separation from the housing to facilitate dumping of the debris in a traditional waste paper basket or the like.

Figure 5:
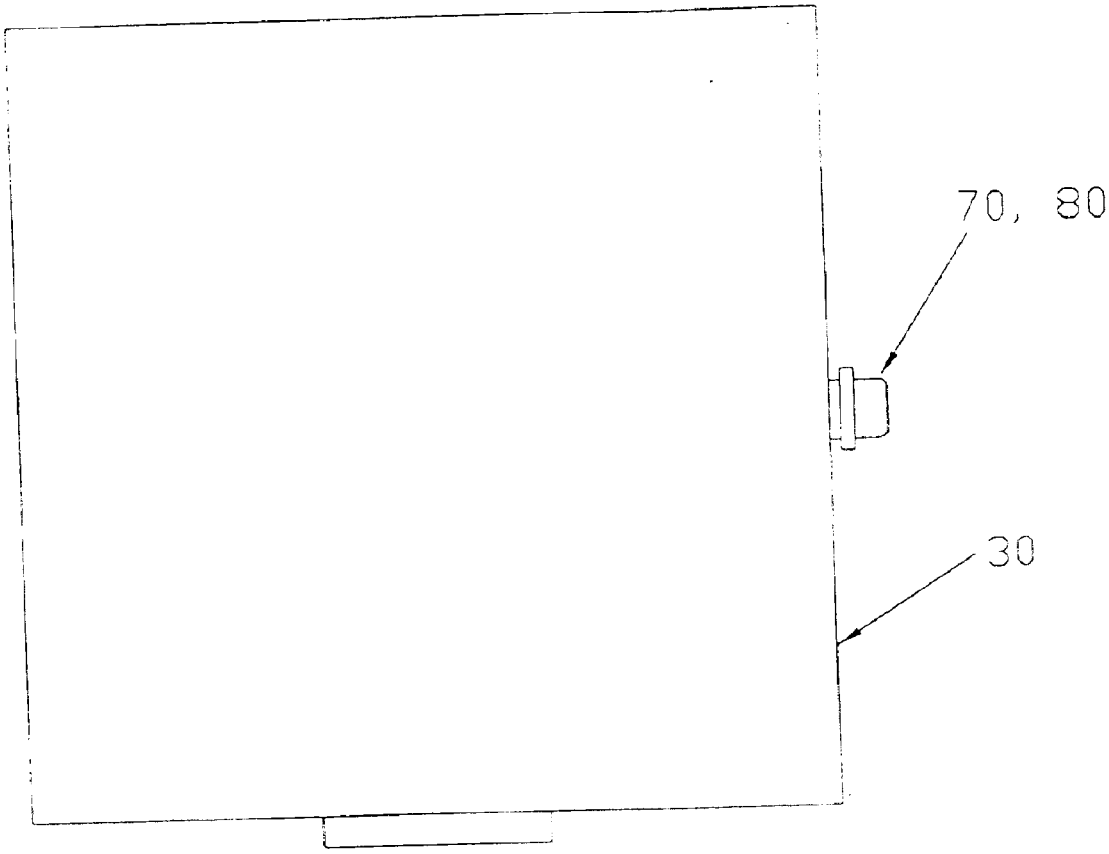
FIG. 5 is a bottom view of the preferred embodiment.

FIG. 5 shows the generally rectangular configuration of the present invention.

Figure 6:
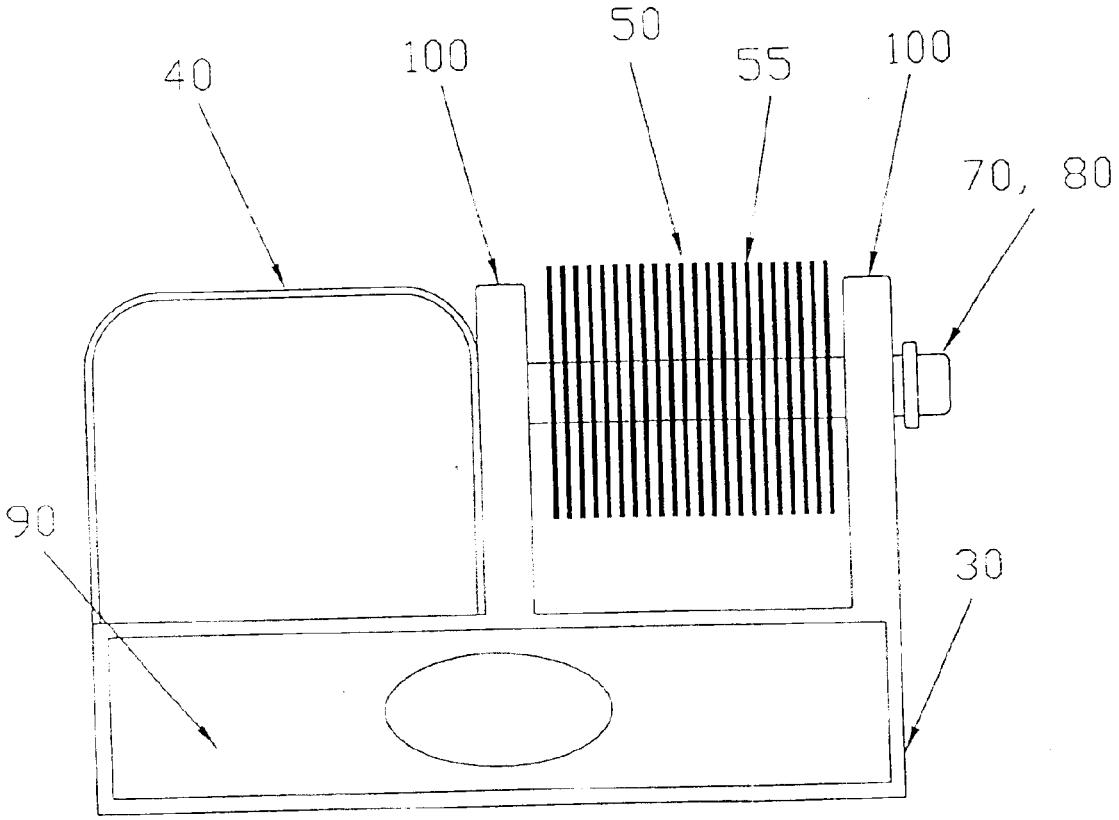
FIG. 6 is a front view of an alternate embodiment of the present invention.
Figure 7:
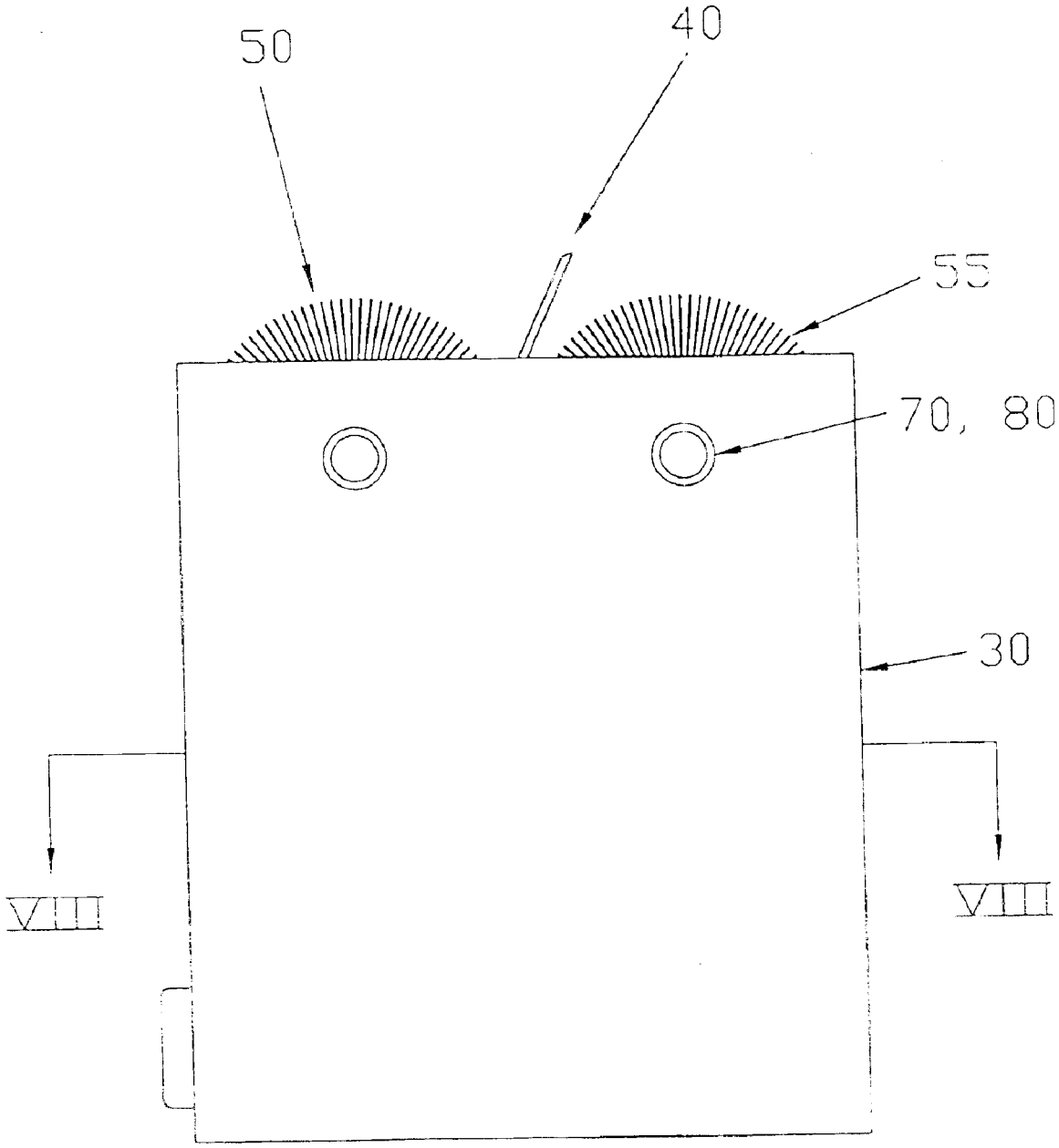
FIG. 7 is a side view of this alternate embodiment of the present invention.
Figure 8:
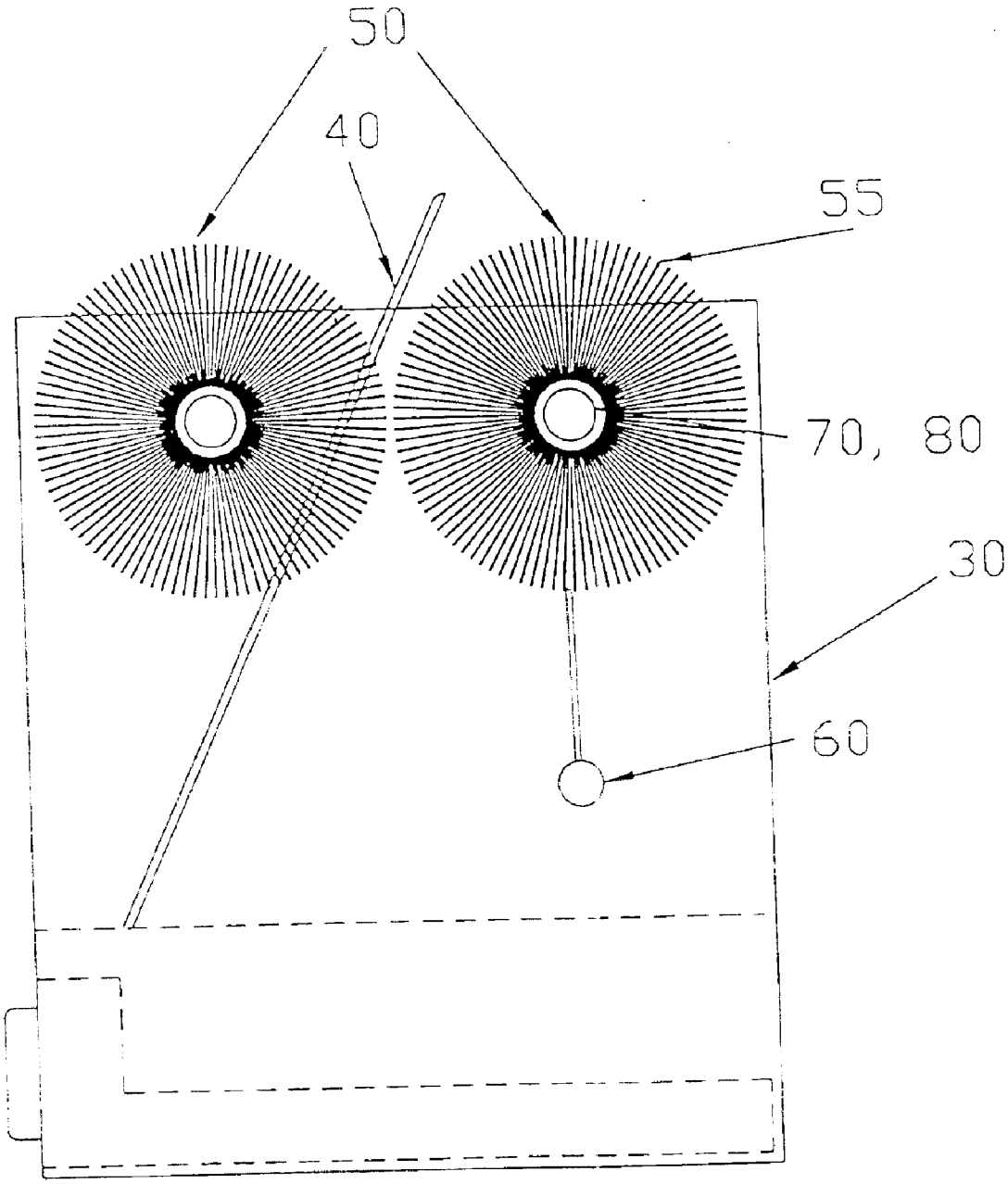
FIG. 8 is a cross-sectional view of the alternate embodiment cut along line VIII of FIG. 7.

Referring now to FIGS. 6, 7 and 8, in an alternate embodiment of the present invention, a plurality of brushes 50 are elevated above the main housing 30 completely, via a pair of parallel brush support posts 100. The brushes 50 are parallel to one another. In addition, the scraper blade 40 is angled relative to the vertical plane.

Figure 9:
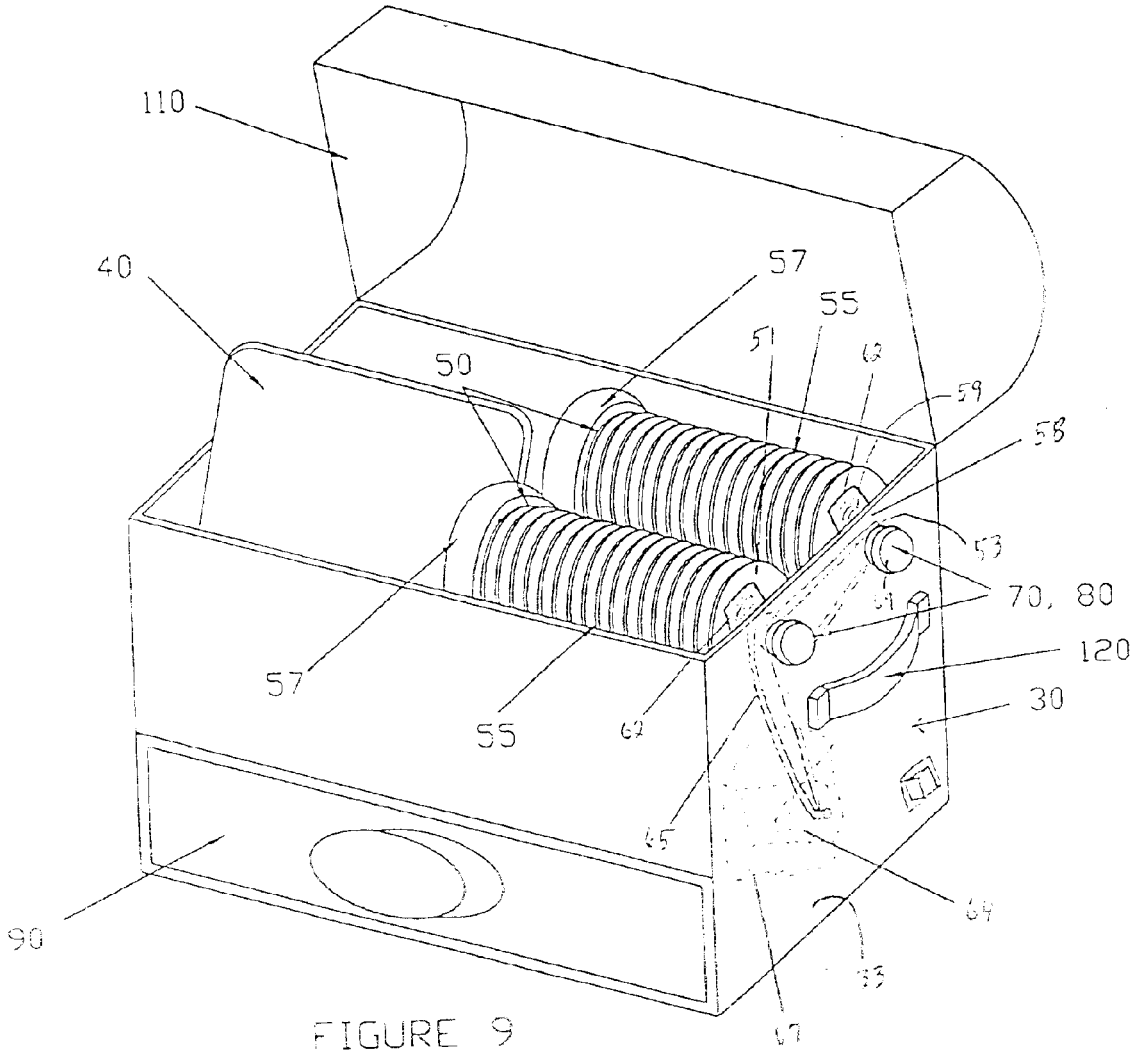
FIG. 9 is a perspective view of another alternate embodiment of the present invention.

Referring now to FIG. 9, in another embodiment of the present invention, the present invention contains a lid 110 coupled to the main housing 30 and a plurality of rotating brushes 50. Rotation of the brushes 50 is powered by an electric motor 64 mounted to a floor 33 of the main housing 30. The motor 64 is housed within a four-sided protective covering 67. A plurality of belts 65, positioned within a hollow interior of the main housing 30, couples rotational power of the motor 64 to the axles 58 of the brushes 50, so as to actuate rotation thereof. In this particular alternate embodiment, the brush cleaning means 60 is attached to an interior wall of the main housing 30, opposite a wall wherein a drawer 90 is located. Handles 120 are used to transport the main housing 30.

It is envisioned that other styles and configurations of the present invention can be easily incorporated into the teachings of the present invention, and only a few particular configuration shall be shown and described for purposes of clarity and disclosure and not by way of limitation of scope.

2. Operation of the Preferred Embodiment

Figure 10A:
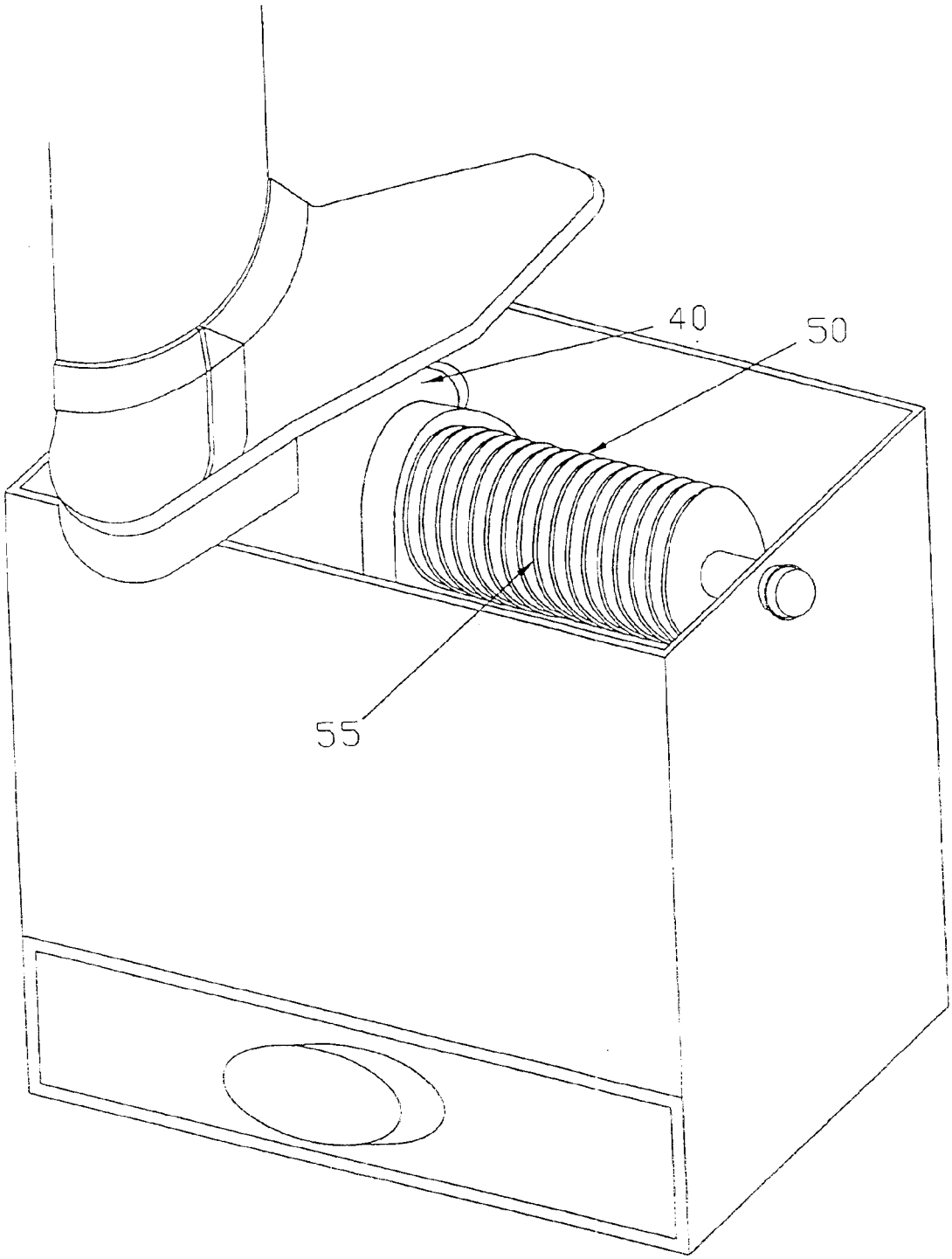
FIGS. 10*a* through 10*c* are a series of in-use views of the preferred embodiment of the present invention.
Figure 10B:
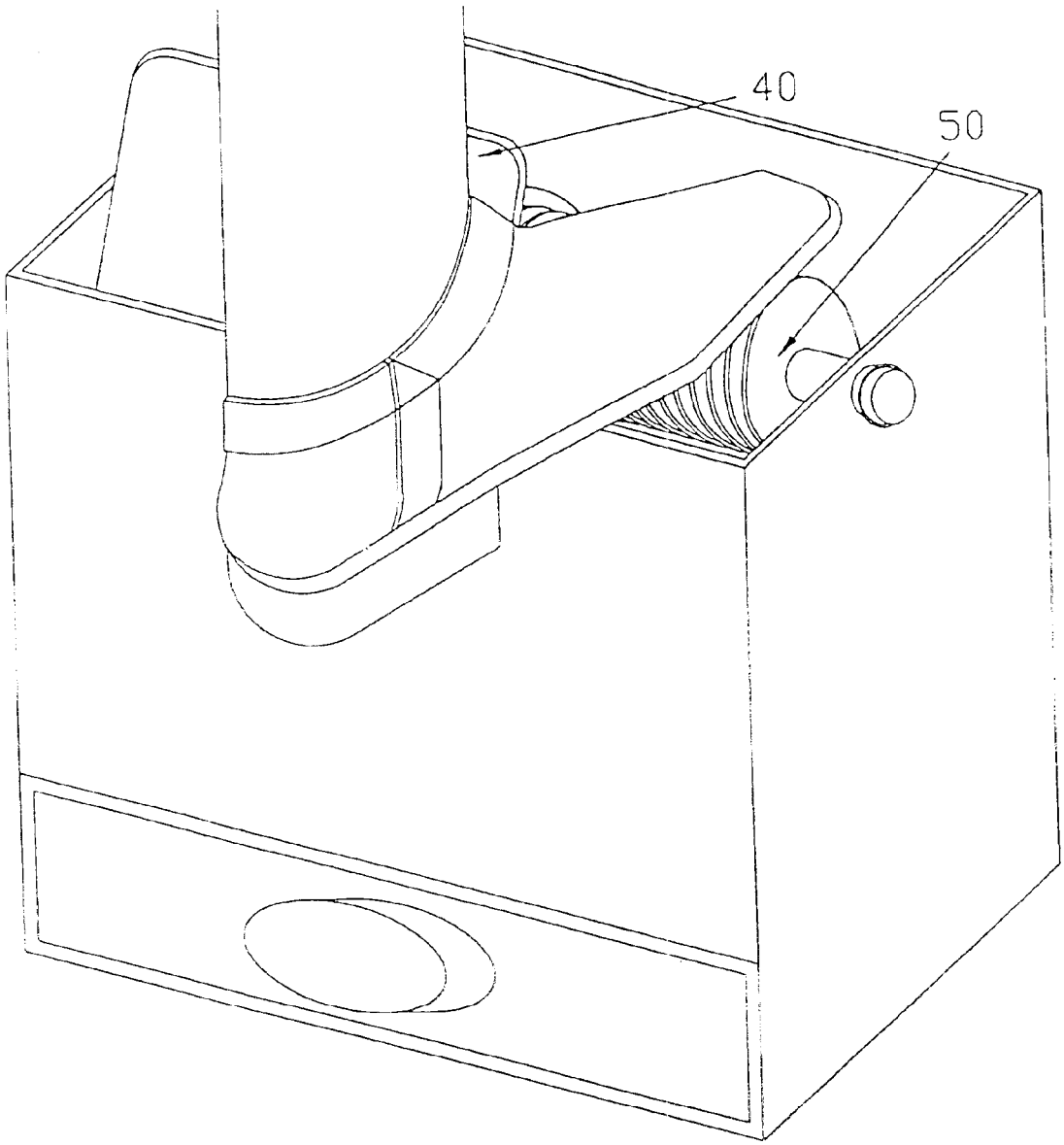
Figure 10C:
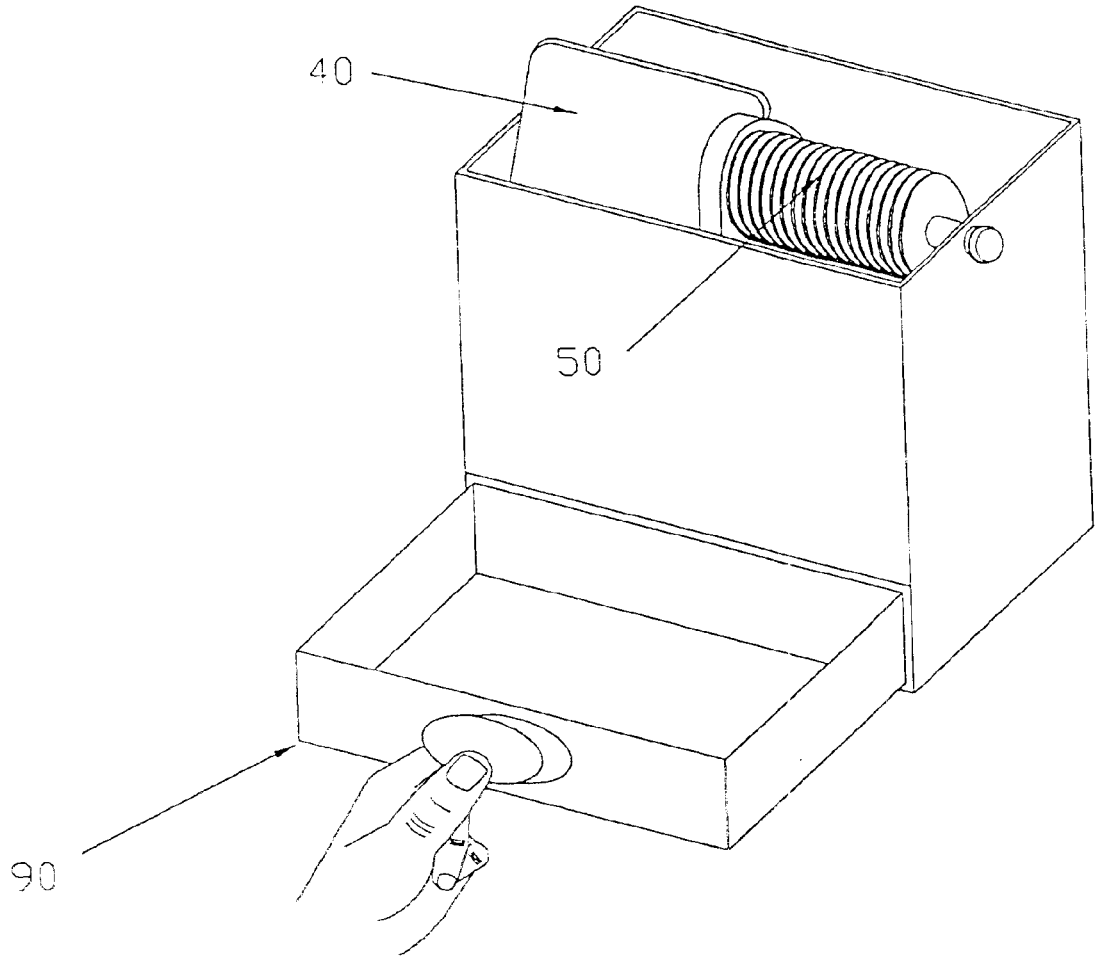

Referring now to FIGS. 10*a* through 10*c*, to use the preferred embodiment of the present invention, one first wipes his or her feet on the scraper bar. This action is intended to remove any heavy buildup of dirt, mud or snow. Next, the user would scrub his or her foot across the inverted brushes 50. This action will remove the remainder of any dirt. The drawer 90 collects any debris that falls from the shoes while they are being cleaned. To empty the present invention, the drawer 90 is removed, emptied and reinserted into the present invention.

The foregoing description is included to illustrate the operation of the preferred embodiment and is not meant to limit the scope of the invention. The scope of the invention is to be limited only by the following claims.

What is claimed is:

1. A shoe and boot cleaning device comprising:

a main housing, said main housing having a generally rectangular and internally hollow configuration;

at least one scraper blade, said scraper blade having a generally flat, rectangular configuration and extending generally upward from the top of said housing;

at least one brush, said brush having a linearly elongated, cylindrical configuration, and attached to said housing, so that said brush rests horizontally along its elongated axis, said brush comprising a cylindrical channel formed therethrough;

hard bristles, said hard bristles located along the exterior circumferential surface area of said brush;

a divider post, said divider post designed to provide lateral support to said brush and said scraper blade;

brush tension control means, said brush tension control means located on the exterior lateral surface of said main housing and designed to adjust a force required to rotate said brush, said brush tension control means comprising a linearly elongated axle inserted through a threaded aperture and into said channel and providing physical communication between said axle and said brush, said brush tension control means further comprising a tension spring and a friction plate, said tension spring disposed about said axle and said friction plate mounted at an end thereof adjacent to an end of said brush, said tension spring biased so as to provide and release force to said axle, said tension spring influenced by turning of a cylindrical knob portion threadably mounted in said aperture;

brush cleaning means, said brush cleaning means located beneath said brush and designed to come into mechanical interference with any mud located on said brush; and a drawer, said drawer located at the bottom of said shoe and boot cleaning device and designed to catch the debris that falls from said scraper blade and or said brush.

2. The shoe and boot cleaning device described in claim 1, wherein said drawer is separable from said main housing to facilitate dumping of debris in a waste basket.

3. The shoe and boot cleaning device described in claim 1, wherein said scraper blade is designed to remove any heavy buildup of debris when a shoe or boot bottom is rubbed against a top of said scraper blade.

4. The shoe and boot cleaning device described in claim 1, wherein said scraper blade extends vertically upward from a top of said main housing.

5. The shoe and boot cleaning device described in claim 1, wherein a plurality of brushes are positioned in a horizontal plane adjacent to and parallel with each other, wherein each of said plurality of brushes has an elongated axis parallel to each of said plurality of brushes in a same horizontal plane.

6. The shoe and boot cleaning device described in claim 1 further comprising:

a lid, said lid coupled to said main housing;

a plurality of brushes powered by an electric motor; and handles, said handles located on the exterior surface of said main housing and designed to facilitate transport of said main housing.

7. The shoe and boot cleaning device described in claim 6 further comprising a plurality of belts coupled about said elongated axes of said brushes, said plurality of belts actuating rotational movement of said plurality of brushes via said electric motor.

8. The shoe and boot cleaning device of claim 1, wherein rotation of said cylindrical knob portion in one direction expands said tension spring, said tension spring placing outward pressure on said friction plate, and said friction plate exerting force against said brush, thereby increasing rotational drag on said brush.

9. The shoe and boot cleaning device of claim 8, wherein rotation of said cylindrical knob portion in an opposite direction contracts said tension spring, said tensions spring releasing outward pressure on said friction plate, and said friction plate releasing force from said brush, thereby decreasing rotational drag on said brush.

10. A shoe and boot cleaning device comprising:

a main housing;

a scraper blade, said scraper blade extending vertically upward from said main housing, said scraper blade affixed to a lateral sidewall of said main housing;

at least one brush, said brush having a linearly elongated and cylindrical shaft and a hollow channel therethrough, said shaft housing a plurality of hard bristles perpendicularly depending exteriorly therefrom;

a divider post, said divider post vertically depending from a base of said main housing and intermediate to said brush and said scraper blade, said divider post providing lateral support to said brush and said scraper blade;

a brush cleaning means, said brush cleaning means affixed to a lateral sidewall of said main housing opposite to said scraper blade and positioned below said brush, said brush cleaning means aligned so that a top edge of said brush cleaning means removes debris from said brush;

a brush tension control means, said brush tension control means located along one of said lateral sidewalls of said main housing and provided to adjust a force required to rotate said brush, said brush tension control means comprising a linearly elongated axle inserted through a threaded aperture and into said channel and providing physical communication between said axle and said brush, said brush tension control means further comprising a tension spring and a friction plate, said tension spring disposed about said axle and said friction plate mounted at an end thereof and adjacent to an end of said brush, said tension spring biased so as to provide force to said axle, said tension spring influenced by turning of a cylindrical knob portion threadably mounted in said aperture; and a drawer, said drawer removably attached to a bottom of said main housing, said drawer provided for housing debris collected from said scraper blade and said brush.

11. The shoe and boot cleaning device of claim 10 further comprising:

a lid, said lid coupled to said main housing;

a plurality of brushes, said plurality of brushes aligned parallel to one another;

an electric motor, said electric motor coupled to said plurality of brushes via a plurality of belts, said plurality of belts coupled about said shaft and said electric motor, thereby providing rotational motion to said plurality of brushes when said electric motor is actuated; and a plurality of handles, said plurality of handles positioned along an exterior surface of said main housing and provided for facilitating transport of said main housing.

12. The shoe and boot cleaning device of claim 11, wherein said electric motor is actuated by an on/off switch, said electric motor rotating said plurality of brushes in relation to rotational drag set by said cylindrical knob portion.

13. The shoe and boot cleaning device of claim 10, said scraper blade placed into a fixed position relative to said main housing, said scraper bladed adjustable between a front of said main housing and a back of said main housing.

14. The shoe and boot cleaning device of claim 10, wherein rotation of said cylindrical knob portion in one direction expands said tension spring, said tension spring placing outward pressure on said friction plate, and said friction plate exerting force against said brush, thereby increasing rotational drag on said brush.

15. The shoe and boot cleaning device of claim 14, wherein rotation of said cylindrical knob portion in an opposite direction contracts said tension spring, said tensions spring releasing outward pressure on said friction plate, and said friction plate releasing force from said brush, thereby decreasing rotational drag on said brush.

* * * * *